US006041820A

United States Patent [19]

Boehme

[11] Patent Number: 6,041,820

[45] Date of Patent: Mar. 28, 2000

[54] SERVICE AND HEATING WATER COMBINED EXPANSION TANK

[76] Inventor: Mathias Boehme, Heckenweq 5, 48165 Muenster, Germany

[21] Appl. No.: 09/154,518

[22] Filed: Sep. 16, 1998

[30] Foreign Application Priority Data

Mar. 20, 1998 [DE] Germany ..... 198 13 970

[51] Int. Cl.[7] ..... F16L 55/04

[52] U.S. Cl. ..... 138/30; 138/26; 237/66; 220/723

[58] Field of Search ..... 138/30, 26; 220/720, 220/723, 530; 237/66

[56] References Cited

U.S. PATENT DOCUMENTS

| | | | |
|---|---|---|---|
| 1,690,072 | 10/1928 | Johnson | 138/30 X |
| 2,342,355 | 2/1944 | Mercier | 138/30 |
| 2,638,932 | 5/1953 | Alexander | 138/30 |
| 2,695,753 | 11/1954 | Kirk, Jr. | 237/8 |
| 3,035,614 | 5/1962 | Kirk, Jr. | 138/30 |
| 3,076,479 | 2/1963 | Ottung | 138/30 |
| 3,077,208 | 2/1963 | Mercier | 138/30 |
| 3,080,119 | 3/1963 | Shutkufski | 237/63 |
| 3,137,317 | 6/1964 | Peters | 138/30 |
| 3,139,113 | 6/1964 | Mercier | 138/30 |
| 3,174,658 | 3/1965 | Wittenberg et al. | 130/30 X |
| 3,230,976 | 1/1966 | Mercier | 138/30 |
| 3,783,905 | 1/1974 | Bottoms | 138/30 |
| 3,802,464 | 4/1974 | Frank et al. | 138/30 |
| 3,807,901 | 4/1974 | Wilson | 138/30 X |
| 4,013,221 | 3/1977 | Eder | 138/30 X |
| 4,129,025 | 12/1978 | Carey et al. | 138/30 X |
| 4,305,428 | 12/1981 | Burton | 138/30 |
| 4,474,215 | 10/1984 | Richter et al. | 138/30 |
| 4,595,037 | 6/1986 | LeBreton et al. | 138/30 |
| 4,784,181 | 11/1988 | Hilverdink | 138/30 |
| 5,368,073 | 11/1994 | Murphy | 138/30 |

FOREIGN PATENT DOCUMENTS

4013897A1 10/1990 Germany .

*Primary Examiner*—Patrick Brinson

[57] ABSTRACT

Expansion tank (10) for receiving volume changes caused by temperature fluctuations in service and heating water systems (28, 29), comprising a tank (11, 11*a*) divided by a diaphragm (16, 22) into a pressurized gas compartment (19, 24) and a water compartment (18, 23). Water compartment (18, 23) communicates through ports (14, 27) with a water system (28, 29). Service water compartment (18) and heating water compartment (23) are integrated in a common tank (11, 11*a*).

12 Claims, 1 Drawing Sheet

SERVICE AND HEATING WATER COMBINED EXPANSION TANK

FIELD OF THE INVENTION

The invention relates to an expansion tank for receiving volume changes caused by temperature fluctuations in service and heating water systems, comprising a vessel divided by means of a diaphragm into a pressurized gas space and a water space, the water space having ports for connection to a water system.

BACKGROUND OF THE INVENTION

In both service water systems and heating water systems, temperature variations may cause the liquid medium—usually water—to undergo volume fluctuations. Such temperature dependent volume fluctuations are compensated for by expansion tanks of the type known by DE 4013897 C2, for example. These expansion tanks are placed under a predetermined pressure to urge incoming water back into the respective systems as temperatures change.

Conventional service water systems are pressurized to approximately 4 bar, whereas heating systems conventionally operate at a pressure of 1.5 to 3 bar. The expansion tanks are necessary for technical reasons, but occupy a certain amount of space and cause additional material expenditures.

SUMMARY OF THE INVENTION

It is an object of the present invention to provide an expansion tank of the type specified above which reduces the space requirements for the water systems involved, as well as the material expenditures incurred.

The above object is achieved by a service water space or compartment and a heating water space or compartment integrated in a common tank. As a further development, the service water space is provided in a service water expansion vessel and the heating water space in a heating water expansion vessel, the service water expansion vessel being separated from the heating water expansion vessel by a partition.

These measures result in an expansion tank suited to receive expansion water from two different water systems. The amounts of water received at any one time may differ, as can the pressures in the respective systems. This renders one of the vessels unnecessary since the remaining one will serve two water systems. As a result, installation labour and expenditures will be reduced substantially.

Additional advantageous measures are described in the dependent claims. The invention is shown in the attached drawing and is described in greater detail hereinafter.

REFERENCE NUMERALS

Figure 1:
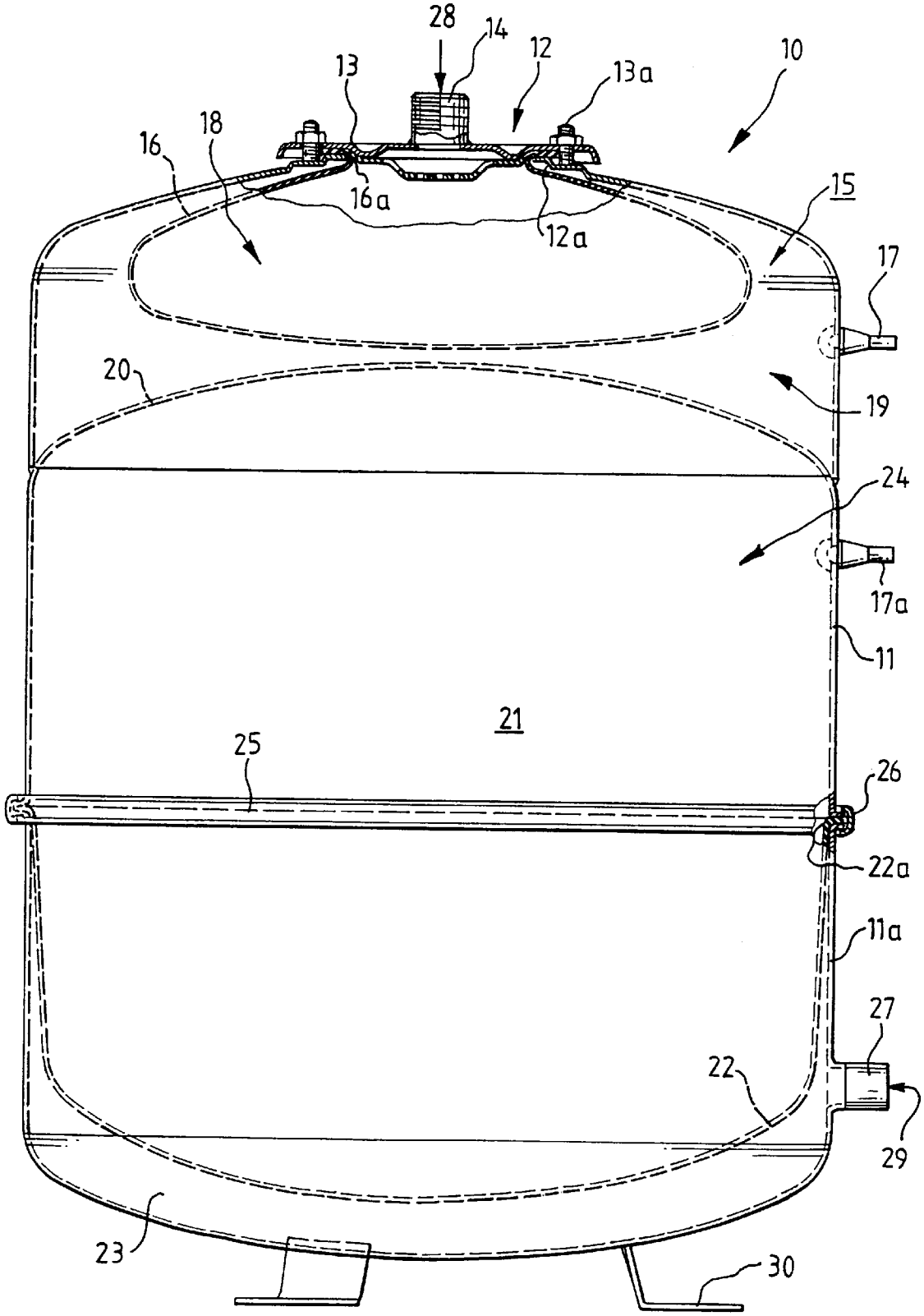
FIG. 1, is a schematic drawing showing the expansion tank of the present invention.

| | |
|---|---|
| 10 | Expansion tank |
| 11 | Top portion of the tank |
| 11a | Bottom portion of the tank |
| 12 | Tank port opening |
| 12a | opening edge |
| 13 | Lid |

-continued

| | |
|---|---|
| 13a | Lid threaded fastener |
| 14 | Service water port |
| 15 | Service water expansion vessel |
| 16 | Diaphragm |
| 16a | Diaphragm bead |
| 17, 17a | Supply valve |
| 18 | Service water compartment |
| 19 | Pressurized gas compartment |
| 20 | Partition |
| 21 | Heating water expansion vessel |
| 22 | Diaphragm |
| 22a | Diaphragm bead |
| 23 | Heating water compartment |
| 24 | Pressurized gas compartment |
| 25 | Vessel dividing plane |
| 26 | Clamping ring |
| 27 | Heating water port |
| 28 | Service water system |
| 29 | Heating system |
| 30 | Foot |

DETAILED DESCRIPTION OF THE INVENTION

As shown schematically in the single drawing figure, a partition 20 divides expansion tank 10 to contain a service water vessel 15 and a heating water vessel 21. Expansion tank 10 preferably consists of sheet steel and has partition 20—also preferably of sheet steel—welded in place therein. Suitable plastics material may be used as well and joined by adhesive bonding.

Expansion tank 10 comprises a vessel top portion 11 and a vessel bottom portion 11*a*, which are separated at a division 25. Top portion 11 has therethrough an opening 12 designed to form a manhole; it may serve as an inspection opening as well. Opening 12 is adapted to be closed by means of a lid 13. Lid 13 is an embossed member and releasably secured around the edge 12*a* of opening 12 by means of threaded fasteners 13*a*.

Opening 12 has a diaphragm 16 inserted therein. Diaphragm 16 preferably is an inflatable bubble type diaphragm and has a diaphragm bead 16*a*. Bead 16*a* engages edge 12*a* of opening 12 where it serves as a seal for lid 13 also.

Diaphragm 16 divides service water vessel 15 into a service water compartment 18 and a pressurized gas compartment 19. Compartment 19 can be pressurized through supply valve 17 with a gas to a pressure level of approximately 10 bar. Service water vessel 15 communicates through a service water port 14 with a service water system (not shown in detail). Service water compartment 19 is defined by diaphragm 16 so that the water will not contact the walls of top portion 11.

A second diaphragm—preferably a pot type diaphragm in the embodiment here described—is inserted at division 25 between top portion 11 and bottom portion 11*a* of the vessel. Diaphragm 22 has a bead 22*a* which also serves as a seal between top portion 11 and bottom portion 11*a*.

Top portion 11 and bottom portion 11*a* are joined by means of a clamping ring 26. Clamping ring 26 is arranged to be releasable by using closure means not shown in greater detail herein.

Diaphragm 22 divides heating water expansion vessel 21 in bottom portion 11*a* into a pressurized gas compartment 24 and a heating water compartment 23. Compartment 24 may be filled with a pressurized gas through a second supply valve 17*a*. Heating water compartment 23 communicates through a heating water port 27 with a heating system 29

(not shown in detail). The heating water from heating system 29 contacts the inner walls of bottom portion 11*a* of the vessel, while the pressurized gas is in the pressurized gas compartment 24 partly defined by diaphragm 22.

Expansion vessel 10 may be set up on feet 30 at a location suited and intended therefor (not shown in detail) inside a building.

What is claimed is:

1. An expansion tank (10) for receiving volume changes caused by temperature fluctuations in service and heating water systems, comprising a heating water expansion vessel (21) divided by a diaphragm (22) into a pressurized gas compartment (24) and a heating water compartment (23), said heating water compartment (23) communicating through ports with a heating water system, and a service water expansion vessel (15) divided by a diaphragm (16) into a pressurized gas compartment (19) and a service water compartment (18), said service water compartment (18) communicating with a service water system, wherein said service water expansion vessel and said heating water expansion vessel (21) are integrated in a common structure forming said expansion tank (10).

2. Expansion tank as in claim 1, characterized in that service water compartment (18) is disposed inside said service water expansion vessel (15) and said heating water compartment (23) is disposed inside said heating water expansion vessel (21), and in that said service water expansion vessel (15) and said heating water expansion vessel (21) are integrated inside said common structure forming said expansion tank (10) and are separated by a partition (20).

3. Expansion tank as in claim 1, characterized in that said service water expansion vessel (15) and said heating water expansion vessel (21) are adapted to be pressurized to different pressure levels.

4. Expansion tank as in claim 1, characterized in that said service water compartment (18) communicates through a service water port (14) with a service water system (28) and in that said heating water compartment (23) communicates with a heating water system (29) through a heating water port (27).

5. Expansion tank as in claim 1, characterized in that said service water expansion vessel (15) has therein said service water compartment (18) in the form of an inflatable bubble-type diaphragm (16).

6. Expansion tank as in claim 1, characterized in that said service water expansion vessel (15) comprises said service water compartment (18) and said pressurized gas compartment (19) and in that said pressurized gas compartment (19) is adapted to be filled with a pressurized gas through a supply valve (17).

7. Expansion tank as in claim 1, characterized in that said pressurized gas compartment (19) encloses said service water compartment (18) inside said service water expansion vessel (15).

8. Expansion tank as in claim 1, characterized in that said heating water expansion vessel (21) comprises a heating water compartment (23) and said pressurized gas compartment (24) and in that said pressurized gas compartment (24) is adapted to be filled with a pressurized gas through a supply valve (17*a*).

9. Expansion tank as in claims 1 and 8, characterized in that said heating water expansion vessel (21) comprises said pressurized gas compartment (24) and said heating water compartment (23) separated by a pot-type diaphragm (22) dividing said heating water expansion vessel (21).

10. Expansion tank as in claim 1, wherein said heating water expansion vessel (21) comprises a top portion (11) and a bottom portion (11*a*), said top portion (11) and said bottom portion (11*a*) being releasably interconnected at a division (25) by means of a clamping ring (26).

11. Expansion tank as in claim 10, wherein said pot-type diaphragm (22) separating said heating water compartment (23) and said pressurized gas compartment (24) has a radially outer peripheral annular bead (22*a*), said bead (22*a*) being held in said division (25) between said top portion (11) and said bottom portion (11*a*) by said clamping ring (26) whereby said bead (22*a*) forms a seal between said top portion (11) and said bottom portion (11*a*).

12. Expansion tank as in claim 2, wherein said partition (20) between said service water expansion vessel (15) and said heating water expansion vessel (21) is rigid and is welded onto top portion (11).

* * * * *